US007335407B2

(12) United States Patent
Landry-Coltrain et al.

(10) Patent No.: US 7,335,407 B2
(45) **Date of Patent: *Feb. 26, 2008**

(54) MULTILAYER INKJET RECORDING ELEMENT WITH POROUS POLYESTER PARTICLE

(75) Inventors: Christine J. Landry-Coltrain, Fairport, NY (US); Jeffrey W. Leon, Rochester, NY (US); Linda M. Franklin, Rochester, NY (US); Xiaoru Wang, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 934 days.

This patent is subject to a terminal disclaimer.

(21) Appl. No.: 10/028,129

(22) Filed: Dec. 20, 2001

(65) Prior Publication Data

US 2003/0138604 A1 Jul. 24, 2003

(51) Int. Cl.
*B41M 5/50* (2006.01)

(52) U.S. Cl. ..... 428/32.25; 428/32.31; 428/32.34; 428/32.37

(58) Field of Classification Search ..... 428/32.25, 428/32.33, 32.35, 32.37, 32.15, 32.2, 32
See application file for complete search history.

(56) References Cited

U.S. PATENT DOCUMENTS

| | | | | |
|---|---|---|---|---|
| 5,360,780 | A | 11/1994 | Okumura et al. | |
| 6,475,602 | B1 * | 11/2002 | Kapusniak et al. | 428/32.34 |
| 6,528,147 | B1 * | 3/2003 | Missell et al. | |
| 2003/0130415 | A1 | 7/2003 | Leon et al. | |
| 2003/0138605 | A1 | 7/2003 | Landry-Coltrain et al. | |

FOREIGN PATENT DOCUMENTS

| | | | |
|---|---|---|---|
| EP | 0 467 528 | A2 | 1/1992 |
| EP | 0 704 315 | A1 | 4/1996 |
| EP | 0 825 296 | A1 | 2/1998 |
| EP | 0 933 225 | A1 | 8/1999 |
| EP | 1 318 025 | A2 | 6/2003 |
| JP | 07-137432 | A | 5/1995 |
| JP | 07-137433 | A | 5/1995 |
| WO | 02/07984 | A2 | 1/2002 |

OTHER PUBLICATIONS

Japanese Patent Abstract 02 055186 A.

* cited by examiner

*Primary Examiner*—Pamela R. Schwartz
(74) *Attorney, Agent, or Firm*—Lynne M. Blank; Chris P. Konkol

(57) ABSTRACT

The present invention comprises an inkjet recording element comprising a support having thereon at least two ink receiving layers capable of accepting an inkjet image, at least one of said layers comprising porous polyester particles. The present invention also includes a method of forming an inkjet print comprising providing an inkjet recording element comprising at least two ink receiving layers capable of accepting an inkjet image, at least one of said layers comprising porous polyester particles and printing on said inkjet recording element utilizing an inkjet printer.

23 Claims, No Drawings

MULTILAYER INKJET RECORDING ELEMENT WITH POROUS POLYESTER PARTICLE

CROSS REFERENCE TO RELATED APPLICATIONS

Reference is made to commonly assigned, U.S. patent applications:

Ser. No. 10/027,701 by Leon et al., filed of even date herewith entitled "Method of Preparation of Porous Polyester Particles" now U.S. Pat. No. 6,780,942; and Ser. No. 10/028,130 by Landry-Coltrain et al., filed of even date herewith entitled "Small Porous Polyester Particles for Inkjet Use.

FIELD OF THE INVENTION

The invention relates to an inkjet recording element, more particularly to a multilayer inkjet recording element containing porous polyester particles.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An inkjet recording element typically comprises a support having on at least one surface thereof at least one ink-receiving or image-forming layer and includes those intended for reflection viewing, which have an opaque support, and those intended for viewing by transmitted light, which have a transparent support.

An inkjet recording element that simultaneously provides an almost instantaneous ink dry time and good image quality is desirable. However, given the wide range of ink compositions and ink volumes that a recording element needs to accommodate, these requirements of inkjet recording media are difficult to achieve simultaneously.

Inkjet recording elements are known that employ porous or non-porous single layer or multilayer coatings that act as suitable ink receiving layers on one or both sides of a porous or non-porous support. Recording elements that use non-porous coatings typically have good image quality and stability but exhibit poor ink dry time. Recording elements that use porous coatings typically contain colloidal particulates and have poorer image stability but exhibit superior dry times.

While a wide variety of different types of porous image recording elements for use with inkjet printing are known, there are many unsolved problems in the art and many deficiencies in the known products, which have severely limited their commercial usefulness. A major challenge in the design of a porous image-recording layer is to be able to obtain good quality, crack-free coatings. Inkjet prints, prepared by printing onto inkjet recording elements, are subject to environmental degradation. They are especially vulnerable to light fade and fade resulting from gaseous impurities in the air, such as ozone and nitrous oxide. Highly swellable hydrophilic layers can take an undesirably long time to dry, slowing printing speed. Porous layers speed the absorption of the ink vehicle, but often suffer from insufficient gloss and severe dye fade. Porous layers are also difficult to coat without cracking.

Japanese Kokai 07-137432 describes an inkjet paper having an ink-absorbing layer containing polyester resin particles with internal pores. However, there is a problem with this element in that the average particle size of the polyester resin is greater than 0.5 microns, and the element will have low surface gloss.

It is an object of this invention to provide an inkjet recording element which will provide rapid ink uptake speed. Another objective of the invention is to provide an inkjet recording element having high surface gloss. Another objective of the invention is to provide an inkjet recording element having a receiving layer that when printed upon has an excellent image quality and stability.

SUMMARY OF THE INVENTION

The present invention comprises an inkjet recording element comprising a support having thereon at least two ink receiving layers capable of accepting an inkjet image, at least one of said layers comprising porous polyester particles. The present invention also includes a method of forming an inkjet print comprising providing an inkjet recording element comprising at least two ink receiving layers capable of accepting an inkjet image, at least one of said layers comprising porous polyester particles and printing on said inkjet recording element utilizing an inkjet printer.

Using the invention, a recording element is obtained which will provide improved ink uptake speed and when printed upon has an excellent image quality.

DETAILED DESCRIPTION OF THE INVENTION

The porous polyester particles useful for this invention consist of the free radical addition polymerization reaction product of an unsaturated precursor polyester with one or more vinyl monomers containing $\alpha,\beta$ ethylenic unsaturation. A precursor polyester is a polyester containing unsaturated groups which is used in turn to make porous polyester particles. The percent of total precursor polyester comprising the particles may be from 5-95% by weight. Preferably, the particles will contain 20-80% by weight of precursor polyester. The porous polyester particles are crosslinked, and are dispersible in water or water-miscible solvents. The porous structure may consist of either continuous or isolated pores.

The porous polyester particles of this invention may be prepared by any of several methods. These include the gradual, electrolyte-induced coalescence of smaller polyester particles, followed by swelling with a vinyl monomer and subsequent crosslinking, as described in Japanese Kokai 07/137,432. Another method of preparation includes the polymerization of a water-in-oil-in-water emulsion in which the oil phase consists of a solution of an unsaturated polyester and one or more vinyl monomers as described in U.S. Pat. Nos. 3,979,342 and 4,089,81.

A more preferred method of preparation is described in U.S. Pat. No. 6,780,942 by Leon et al., entitled "Method of Preparation of Porous Polyester Particles", in which the crosslinked, porous polyester particles are prepared by crosslinking an unsaturated precursor polyester within an oil-in-water emulsion in the presence of a water-immiscible organic solvent. The crosslinking reaction is a radical-initiated polymerization of an ethylenically unsaturated monomer, which readily copolymerizes with the unsaturated units in the precursor polyester. The precursor polyester can be organic-soluble, in which case an added emulsifying agent is necessary. In another embodiment of this method, the precursor polyester can be water-soluble, water-dispersible, or amphiphilic in character, in which case the precursor polyester acts as the emulsifying species and an added emulsifying agent is merely optional. The water-immiscible organic solvent is removed to yield a dispersion of porous, crosslinked, polyester-containing particles.

The precursor polyesters useful for the preparation of the porous polyester particles of this invention are branched or unbranched, contain chemical unsaturation, and are soluble either in water-immiscible organic solvents or in water. Optionally, the precursor polyester may be self-emulsifying in water or amphiphilic or surfactant-like in character. The precursor polyesters may have any glass transition temperature, provided the precursor polyester fulfills the solubility requirements. Preferably, the number average molecular weight (Mn) is between 1,000 and 30,000 gm/mole.

As is well known in the art, polyesters are condensation products of polybasic acids or of corresponding acid equivalent derivatives such as esters, anhydrides or acid chlorides and polyhydric alcohols. It will be known that whenever "diacids" or "polyacids" are referred to in this document, that corresponding acid equivalent derivatives such as esters, anhydrides or acid chlorides are also included by reference. Polymerizable unsaturation may be introduced into the molecule by the selection of a polybasic acid or polyhydric alcohol, which contains $\alpha,\beta$-ethylenic unsaturation. In most cases, the unsaturation will be contained within the polybasic acid unit. Optionally, one or more additional polyacids common in the art of polycondensation may be used in addition to the unsaturated polyacid. The ethylenically unsaturated polyacids include, but are not necessarily limited to maleic, fumaric, itaconic, phenylenediacrylic, citraconic and mesaconic acid. Other, additional polyacids which do not contain chemical unsaturation and can be used in precursor polyesters are described in WO 01/00703 and are incorporated herein by reference. These diacids can include, but are not necessarily limited to malonic, succinic, glutaric, adipic, pimelic, azelaic, and sebacic acids, phthalic, isophthalic, terephthalic, tetrachlorophthalic, tetrahydrophthalic, trimellitic, trimesic, isomers of naphthalenedicarboxylic acid, chlorendic acid, trimellitic acid, trimesic acid, and pyromellitic acid.

Ethylenically unsaturated groups can also be introduced into the precursor polyester by synthetic modification. For example, a polyester with a high alcohol number can be reacted with an anhydride or acid chloride of acrylic acid or methacrylic acid in order to introduce ethylenically unsaturated units.

Precursor polyesters that are suitable for the particles of this invention can furthermore be comprised of any of a wide variety of polyhydric alcohols which are well known in the art of polycondensation and may be aliphatic, alicyclic, or aralkyl. A description of suitable polyhydric alcohols is given in WO 01/00703 and are incorporated herein by reference. These alcohols can include, but are not necessarily limited to ethylene glycol, 1,3-propylene glycol, 1,6-hexanediol, 1,10-decanediol, 1,4-cyclohexanedimethanol, 1,4-cyclohexanediol, hydroquinone bis (hydroxyethyl) ether, diethylene glycol, neopentyl glycol, bisphenols such as bisphenol A, ethylene oxide and propylene oxide adducts of bisphenol A, pentaerythritol, trimethylolpropane, and polyester polyols, such as that obtained by the ring-opening polymerization of $\epsilon$-caprolactone. Additionally, A-B type polycondensation monomers which contain both hydroxyl and acid derivative functions can be used as well as monoacids and monoalcohols.

In one variation of this method of preparation, precursor polyesters which are water-soluble, surfactant-like, or self-emulsifying and additionally contain chemical unsaturation may be utilized. Water-soluble, surfactant-like, and self-emulsifying precursor polyesters are well known in the art and will contain one or more types of hydrophilic chemical group or functionality, or monomer, such as carboxylate, quaternary ammonium, sulfonate, sulfate, sulfonium, phosphonium, iminosulfonyl, or polymeric or oligomeric oxyethylene segments. Precursor polyesters used to form the porous polyester particles useful in this invention will additionally contain one or more polyacid or polyol monomers which contain ethylenic unsaturation as detailed above. The water-soluble, surfactant-like, and self-emulsifying precursor polyesters used to form the porous polyester particles useful in this invention may contain one or more diacid or diol components which can induce hydrophilic character or water-solubility. The most common hydrophilic diol used for this purpose is polyethylene glycol. Additionally, tertiary amine units substituted with two or three hydroxyalkyl groups can be incorporated within a precursor polyester and rendered ionic either by quaternization with an alkylating agent or by neutralization with an acid. A commonly used class of diacid components used to impart hydrophilicity to precursor polyesters includes compounds containing sulfonate or sulfonimide salts. Some suitable sulfonated diacids are described in U.S. Pat. Nos. 4,973,656 and 5,218,042 and are incorporated herein by reference. Examples of such diacids are 5-sodiosulfoisophthalic acid, 2-sodiosulfobutanoic acid, and di-Me sodioiminobis(sulfonyl-m-benzoate). Another common strategy for the hydrophilization of precursor polyesters involves the neutralization of the acid end groups of polyester with a relatively high acid number. Preferably, the acid number is at least 10. Most preferably the acid number is greater than 25. The neutralization agent is usually an alkali metal hydroxide or an amine. Precursor polyesters containing ethylenic unsaturation and neutralized acid end groups can also be used in this invention. In the preferred case, the unsaturated precursor polyester will contain an ionic group equivalent weight of between 400 and 2000 grams of polymer per mole of ionic unit.

The ethylenically unsaturated monomers useful for crosslinking the precursor polyesters in the particles of this invention are monomers commonly used in the art of addition polymerization. These include, but are not necessarily limited to methacrylic acid esters, such as methyl methacrylate, ethyl methacrylate, isobutyl methacrylate, 2-ethylhexyl methacrylate, benzyl methacrylate, phenoxyethyl methacrylate, cyclohexyl methacrylate and glycidyl methacrylate, acrylate esters such as methyl acrylate, ethyl acrylate, isobutyl acrylate, 2-ethylhexyl acrylate, benzyl methacrylate, phenoxyethyl acrylate, cyclohexyl acrylate, and glycidyl acrylate, styrenics such as styrene, $\alpha$-methylstyrene, 3- and 4-chloromethylstyrene, halogen-substituted styrenes, and alkyl-substituted styrenes, vinyl halides and vinylidene halides, N-alkylated acrylamides and methacrylamides, vinyl esters such as vinyl acetate and vinyl benzoate, vinyl ethers, such as butyl vinyl ether and cycloxexanedimethanol divinyl ether, allyl alcohol and its ethers and esters, and unsaturated ketones and aldehydes such as acrolein and methyl vinyl ketone and acrylonitrile.

In addition, small amounts (typically less than 10% of the total weight of the polymerizeable solids) of one or more water-soluble ethylenically unsaturated monomer can be used. Such monomers include but are not necessarily limited to styrenics, acrylates, and methacrylates substituted with highly polar groups, unsaturated carbon and heteroatom acids such as acrylic acid, methacrylic acid, fumaric acid, maleic acid, itaconic acid, vinylsulfonic acid, vinylphosphonic acid, and their salts, vinylcarbazole, vinylimidazole, vinylpyrrolidone, and vinylpyridines.

Especially useful in the polyester particles of this invention are monomers containing more than one ethylenically unsaturated unit, such as trimethylolpropane triacrylate, ethylene glycol dimethacrylate, isomers of divinylbenzene, divinyl adipate, cyclohexanedimethanol divinyl ether and ethylene glycol divinyl ether.

Ethylenically unsaturated monomers which are preferred for the particles of this invention are styrenics, vinyl ethers, and methacrylates. Divinylbenzene (m, and p isomers), styrene, divinyl adipate, and ethylene glycol dimethacrylate are especially preferred.

Any of the common water-soluble or organic-soluble free radical polymerization initiators known in the art of addition polymerization can be used for the particles of this invention. These include, but are not restricted to azo compounds, such as 2,2'-azobis(4-methoxy-2,4-dimethylvaleronitrile), (1-pheneylethyl) azodiphenylmethane, 2-2'-azoisobutyronitrile (AIBN), 1,1'-azobis(1-cyclohexanedicarbonitrile), 4,4'-azobis(4-cyanopentanoic acid), and 2,2'-azobis(2-amidinopropane) dihydrochloride, organic peroxides, organic hydroperoxides, peresters, and peracids such as benzoyl peroxide, lauryl peroxide, capryl peroxide, acetyl peroxide, t-butyl hydroperoxide, t-butyl perbenzoate, cumyl hydroperoxide, peracetic acid, 2,5-dimethyl-2,5-di(peroxybenzoate), and p-chlorobenzoly peroxide, persulfate salts such as potassium, sodium and ammonium persulfate, disulfides, tetrazenes, and redox initiator systems such as $H_2O_2/Fe^{2+}$, persulfate/bisulfite, oxalic acid/$Mn^{3+}$, thiourea/$Fe^{3+}$, and benzoyl perozide/dimethylaniline.

Optionally, a small amount of a cosurfactant stabilizer, typically comprising 1-10% by weight of the organic phase, may be added to the organic phase. These hydrophobic compounds are known to prevent Ostwald ripening in certain types of emulsion and suspension polymerization. Excellent discussions of cosurfactants are given in *Emulsion Polymerization and Emulsion Polymers* by Peter A Lovell and Mohammed S. El-Aaser, (John Wiley and Sons: Chichester, 1997, pp. 700-721) and U.S. Pat. No. 5,858,634. The most common cosurfactants are hexadecane and hexadecanol. Other useful cosurfactants may also serve other roles, such as acting as monomers or initiators. An example of the former is lauryl methacrylate. An example of the latter is lauroyl peroxide.

If a precursor polyester is used, which is not soluble or dispersible in water, then an emulsifier must additionally be used, although an emulsifier can be used in tandem with a water-soluble or water-dispersible precursor polyester. It is preferable that the emulsifier be initially dissolved in the aqueous phase. Though a very large variety of emulsifiers are known in the art, most of these fit into the three basic categories of surfactants, colloidal inorganics, and protective colloids. There exist a tremendous number of known surfactants. Good reference sources for surfactants are the *Surfactant Handbook* (GPO: Washington, D. C., 1971) and *McCutcheon's Emulsifiers and Detergents* (Manufacturing Confectioner Publishing Company: Glen Rock, 1992). There are no general restrictions for the surfactants which are useful in the preparation of porous polyester particles. Useful surfactants can be anionic, cationic, zwitterionic, neutral, low molecular weight, macromolecular, synthetic, or extracted or derived from natural sources. Some examples include, but are not necessarily limited to: sodium dodecylsulfate, sodium dodecylbenzenesulfonate, sulfosuccinate esters, such as those sold under the AEROSOL® trade name, flourosurfactants, such as those sold under the ZONYL® and FLUORAD® trade names, ethoxylated alkylphenols, such as TRITON® X-100 and TRITON® X-705, ethoxylated alkylphenol sulfates, such as RHODAPEX® CO-436, phosphate ester surfactants such as GAFAC® RE-90, hexadecyltrimethylammonium bromide, polyoxyethylenated long-chain amines and their quaternized derivatives, ethoxylated silicones, alkanolamine condensates, polyethylene oxide-co-polypropylene oxide block copolymers, such as those sold under the PLURONIC® and TECTRONIC® trade names, N-alkylbetaines, N-alkyl amine oxides, and fluorocarbon-poly(ethylene oxide) block surfactants, such as FLUORAD® FC-430.

Protective colloids useful in the preparation of porous polyester particles include, but are not necessarily limited to: poly (ethylene oxide), hydroxyethyl cellulose, poly (vinyl alcohol), poly (vinyl pyrrolidone), polyacrylamides, polymethacrylamides, sulfonated polystyrenes, alginates, carboxy methyl cellulose, polymers and copolymers of dimethylaminoethylmethacrylate, water soluble complex resinous amine condensation products of ethylene oxide, urea and formaldehyde, polyethyleneimine, casein, gelatin, albumin, gluten and xanthan gum. Protective colloids are a class of emulsifiers which are used in lieu of or in addition to a surfactant. They are typically dissolved or dispersed in the aqueous phase prior to the emulsification step.

Similarly, colloidal inorganic particles can be employed as emulsifiers as part of a limited coalescence process. Colloidal inorganic particles can be employed in lieu of or in addition to any other type of emulsifier listed, such as a surfactant or protective colloid. They are also dispersed in the aqueous phase. Limited coalescence techniques have been describe in numerous patents such as U.S. Pat. Nos. 4,833,060 and 4,965,131. A colloidal inorganic which is particularly useful in this invention is LUDOX®™ sold by Du Pont.

Additional additives which can be incorporated into the porous polyester particles useful in this invention include pigments, dyes, biocides, fungicides, electrolytes, buffers, UV-absorbers, antioxidants and chain transfer agents.

The porous polyester particles useful for this invention comprise porous polyester particles having a mean diameter of between less than 0.1 micrometers and 10 micrometers. When the porous polyester particles are in the topmost layer, it is preferable that the porous polyester particles have a mean diameter range between 0.1 and less than 0.5 micrometers, and more preferably, that the porous polyester particles have a mean diameter range between 0.2 and 0.3 micrometers. For optimal ink absorption properties and coating quality of the lower layer(s), it is preferable that the porous polyester particles have a mean diameter greater than 0.5 micrometers, preferably having a mean diameter between 1 and 10 micrometers, and most preferably having a mean diameter between 1 and 3 micrometers. The diameter of the particles can be measured by any method known in the art. One such method is laser light scattering of dilute dispersions of the particles, using a commercially available instrument such as the Horiba LA-920, manufactured by Horiba LTD. Typically, a sample of porous polyester particles will contain a population of particles having a distribution of sizes. This is the particle size distribution, and is characterized by a mean diameter, a standard deviation, and a coefficient of variation. The mathematical equations defining these terms can be found in any basic text on statistical analysis, such as "Principles of Instrumental Analysis, 4th Edition", by D. A. Skoog and J. J. Leary, Harcourt Brace College Publishers, Orlando, Fla., 1971 (Appendix A-6). The mean diameter is the arithmetic mean of the particle size distribution. The coefficient of variation (CV) of a distribution is the ratio of the standard deviation of the distribution to the mean diameter, given as a percent. The porous polyester particles useful for this invention can have a relatively large distribution of particle sizes within one mode. In a system of particles, there can be a single mode or peak to this distribution of sizes, or there can be several modes, each mode being characterized by a mean diameter, a standard deviation, and a coefficient of variation. For example, the porous polyester particles can be a system composed of particles having a mode with a mean diameter of less than 0.5 micrometers and particles having a mode with mean diameter greater than 0.5 micrometers, preferably having a mean diameter between 1 and 10 micrometers, and most preferably having a mean diameter between 1 and 3 micrometers. The relative proportions of these two modes are calculated from the relative areas under the curves representing the modes, and should add up to 100%.

In the preferred case, the porous polyester particles will contain an ionic group equivalent weight of between 40 and 2000 grams per mole of ionic unit. The product particles, having excellent colloidal stability, can be stored as an aqueous dispersion or freeze dried to yield a solid powder comprising dry particles which will easily redisperse in water.

The ink receiving element utilized in the invention contains at least two individual ink receiving layers. Each layer being comprised of a different composition, combination of particles with differing chemical nature and different mean diameters, and layer thickness. For these multilayer structures, the terms as used herein, "top", "upper", and "above" mean the layer that is farther from the support in relation to the relative positioning with respect to the other layers. The terms "bottom" "lower" and "below" mean the layer that is closer to the support in relation to the relative positioning with respect to the other layers. The term "topmost" means the layer that is the farthest from the support relative to all other layers.

The organic particles in either of said layers useful for this invention include non-coalescing latex particles and core-shell latex particles, such as polyolefins, polyethylene, polypropylene, polystyrene, poly(styrene-co-butadiene), polyurethane, polyester, poly(acrylate), poly(methacrylate), copolymers of n-butylacrylate and ethylacrylate, copolymers of vinylacetate and n-butylacrylate, copolymers of methyl methacrylate and sodium 2-sulfo-1,1-dimethylethyl acrylamide, and copolymers of ethyl acrylate, vinylidene chloride and sodium 2-sulfo-1,1-dimethylethyl acrylamide or mixtures thereof. These can be internally crosslinked or uncrosslinked. It is preferable that uncrosslinked latex particles have a film formation temperature above 25° C. Organic particles useful for this invention can also be porous acrylic, methacrylic, or styrenic polymer particles.

The inorganic particles in either of said layers useful for this invention include any inorganic oxide, including silica, colloidal silica, fumed silica, alumina, colloidal alumina, fumed alumina, calcium carbonate, kaolin, talc, calcium sulfate, natural or synthetic clay, barium sulfate, titanium dioxide, zinc oxide, or mixtures thereof. Mixtures of organic and inorganic particles may also be used.

The organic particles and inorganic particles can be of any size, however, it is preferable that their mean particle diameter be of less than 0.5 micrometers if the layer containing these particles is the topmost layer.

The polymers useful in either of said layers free of particles for this invention include hydrophilic organic polymers and lightly crosslinked hydrogels such as polyvinylpyrrolidone and vinylpyrrolidone-containing copolymers, polyethyloxazoline and oxazoline-containing copolymers, imidazole-containing polymers, polyacrylamides and acrylamide-containing copolymers, poly(vinyl alcohol) and vinyl-alcohol-containing copolymers, poly(vinyl methyl ether), poly(vinyl ethyl ether), poly(alkylene oxide), gelatin, cellulose ethers, poly(vinylacetamides), partially hydrolyzed poly(vinyl acetate/vinyl alcohol), poly (acrylic acid), sulfonated or phosphated polyesters and polystyrenes, casein, albumin, chitin, chitosan, dextran, pectin, collagen derivatives, collodian, agar-agar, arrowroot, guar, carrageenan, tragacanth, xanthan, rhamsan and the like, hydroxyethyl cellulose, hydroxypropyl cellulose, hydroxypropyl methyl cellulose, methyl cellulose, a poly(alkylene oxide), and water dispersible polyurethane. Mixtures of the above listed hydrophilic polymers can be used.

The ink receiving layers of the inkjet element are formed by coating a mixture comprised of either the porous polyester particles, organic particles, or inorganic particles and a binder in an amount insufficient to alter the porosity of the porous receiving layers onto a support, and then drying to remove approximately all of the volatile components. In a preferred embodiment, the polymeric binder is a hydrophilic polymer such as polyvinylpyrrolidone and vinylpyrrolidone-containing copolymers, polyethyloxazoline and oxazoline-containing copolymers, imidazole-containing polymers, polyacrylamides and acrylamide-containing copolymers, poly(vinyl alcohol) and vinyl-alcohol-containing copolymers, poly(vinyl methyl ether), poly(vinyl ethyl ether), poly(alkylene oxides), gelatin, cellulose ethers, poly(vinylacetamides), partially hydrolyzed poly(vinyl acetate/vinyl alcohol), poly(acrylic acid), sulfonated or phosphated polyesters and polystyrenes, casein, albumin, chitin, chitosan, dextran, pectin, collagen derivatives, collodian, agar-agar, arrowroot, guar, carrageenan, tragacanth, xanthan, rhamsan and the like. In another preferred embodiment of the invention, the hydrophilic polymer is hydroxyethyl cellulose, hydroxypropyl cellulose, hydroxypropyl methyl cellulose, methyl cellulose, or a poly(alkylene oxide). In still another preferred embodiment, the polymeric binder is a latex such as poly(styrene-co-butadiene), polyurethane, polyester, poly (acrylate), poly(methacrylate), a copolymer of n-butylacrylate and ethylacrylate, and a copolymer of vinylacetate and n-butylacrylate. In still another preferred embodiment, the binder is a condensate of alkoxysilanes or other metal sols such as alumina sol, titania sol, or zirconia sol. Mixtures of the above listed hydrophilic polymers can be used. The binder should be chosen so that it is compatible with the aforementioned particles.

The amount of polymer binder used should be sufficient to impart cohesive strength to the inkjet recording element, but should also be minimized so that the interconnected pore structure formed by the aggregates is not filled in by the binder. In a preferred embodiment of the invention, the polymer binder is present in an amount of between 5 and 50% by weight, and most preferably, in an amount between 10 and 25% by weight of each layer. The porous polymer particles comprise between 50 and 95% by weight of an individual layer. The particles preferably comprise between 75 and 90% by weight of an individual layer.

The total thickness of the combined ink receiving layers may range from about 5 to about 100 μm, preferably from about 10 to about 50 μm. Each layer may have a different thickness relative to the other layers. However, it is typical that the topmost layer be thin relative to the lower layers. A preferred thickness of the topmost layer is from about 1 to about 20 μm, more preferably from about 1 to about 10 μm. The coating thickness required is determined through the need for the coating to act as a sump for absorption of ink solvent and the need to hold the ink near the coating surface.

Since the image recording element may come in contact with other image recording articles or the drive or transport mechanisms of image recording devices, additives such as filler particles, surfactants, lubricants, crosslinking agents, matte particles and the like may be added to the element to the extent that they do not degrade the properties of interest.

Filler particles may be used in the ink receiving layer containing porous polyester particles such as silicon oxide, fumed silica, silicon oxide dispersions such as those available from Nissan Chemical Industries and DuPont Corp., aluminum oxide, fumed alumina, calcium carbonate, barium sulfate, barium sulfate mixtures with zinc sulfide, inorganic powders such as γ-aluminum oxide, chromium oxide, iron oxide, tin oxide, doped tin oxide, alumino-silicate, titanium dioxide, silicon carbide, titanium carbide, and diamond in fine powder, as described in U.S. Pat. No. 5,432,050.

A dispersing agent, or wetting agent can be present to facilitate the dispersion of the filler particles. This helps to minimize the agglomeration of the particles. Useful dispersing agents include, but are not limited to, fatty acid amines and commercially available wetting agents such as Solsperse® sold by Zeneca, Inc. (ICI). Preferred filler particles are silicon oxide, aluminum oxide, calcium carbonate, and barium sulfate. Preferably, these filler particles have a median diameter less than 1.0 μm. The filler particles can be present in the amount from about 0 to 80 percent of the total solids in the dried ink receiving layer, most preferably in the amount from about 0 to 40 percent.

The inkjet element may include lubricating agents. Lubricants and waxes useful either in the ink receiving layers or on the side of the element that is opposite the ink receiving layers include, but are not limited to, polyethylenes, silicone waxes, natural waxes such as carnauba, polytetrafluoroethylene, fluorinated ethylene propylene, silicone oils such as polydimethylsiloxane, fluorinated silicones, functionalized silicones, stearates, polyvinylstearate, fatty acid salts, and perfluoroethers. Aqueous or non-aqueous dispersions of submicron size wax particles such as those offered commercially as, but not limited to, dispersions of polyolefins, polypropylene, polyethylene, high density polyethylene, microcrystalline wax, paraffin, natural waxes such as carnauba wax, and synthetic waxes from such companies as Chemical Corporation of America (Chemcor), Inc., Michelman Inc., Shamrock Technologies Inc., and Daniel Products Company, are useful.

In order to obtain adequate coatability, additives known to those familiar with such art such as surfactants, defoamers, alcohol and the like may be used. Coating aids and surfactants include, but are not limited to, nonionic fluorinated alkyl esters such as FC-430®, FC-431®, FC-10®, FC-171® sold by Minnesota Mining and Manufacturing Co., Zonyl® fluorochemicals such as Zonyl-FSN®, Zonyl-FTS®, Zonyl-TBS®, Zonyl-BA® sold by DuPont Corp., other fluorinated polymer or copolymers such as Modiper F600® sold by NOF Corporation, polysiloxanes such as Dow Corning DC 1248®, DC200®, DC510®, DC 190® and BYK 320®, BYK 322®, sold by BYK Chemie and SF 1079®, SF 1023®, SF 1054®, and SF 1080® sold by General Electric, and the Silwet® polymers sold by Union Carbide, polyoxyethylene-lauryl ether surfactants, sorbitan laurate, palmitate and stearates such as Span® surfactants sold by Aldrich, poly(oxyethylene-co-oxypropylene) surfactants such as the Pluronic® family sold by BASF, and other polyoxyethylene-containing surfactants such as the Triton X® family sold by Union Carbide, ionic surfactants, such as the Alkanol® series sold by DuPont Corp., and the Dowfax® family sold by Dow Chemical. Specific examples are described in MCCUTCHEON's Volume 1: Emulsifiers and Detergents, 1995, North American Edition.

The ink receiving layers may include crosslinking agents. Any crosslinking agent may be used provided its reactive functionalities have the appropriate reactivity with specific chemical units in the binder. Some common crosslinkers which can crosslink binders rich in lewis basic functionalities include, but are not necessarily limited to: carbodiimides, polyvalent metal cations, organic isocyanates such as tetramethylene diisocyanate, hexamethylene diisocyanate, diisocyanato dimethylcyclohexane, dicyclohexylmethane diisocyanate, isophorone diisocyanate, dimethylbenzene diisocyanate, methylcyclohexylene diisocyanate, lysine diisocyanate, tolylene diisocyanate, diphenylmethane diisocyanate, aziridines such as taught in U.S. Pat. No. 4,225,665, ethyleneimines such as Xama-7® sold by EIT Industries, blocked isocyanates such as CA BI-12 sold by Cytec Industries, melamines such as methoxymethylmelamine as taught in U.S. Pat. No. 5,198,499, alkoxysilane coupling agents including those with epoxy, amine, hydroxyl, isocyanate, or vinyl functionality, Cymel® crosslinking agents such as Cymel 300®, Cymel 303®, Cymel 1170®, Cymel 1171® sold by Cytec Industries, and bis-epoxides such as the Epon® family sold by Shell. Other crosslinking agents include compounds such as aryloylureas, aldehydes, dialdehydes and blocked dialdehydes, chlorotriazines, carbamoyl pyridiniums, pyridinium ethers, formamidinium ethers, vinyl sulfones, boric acid, dihydroxydioxane, and polyfunctional aziridines such as CX-100 (manufactured by Zeneca Resins). Such crosslinking agents can be low molecular weight compounds or polymers, as discussed in U.S. Pat. No. 4,161,407 and references cited.

To improve colorant fade, UV absorbers, radical quenchers or antioxidants may also be added to the ink-receiving layers as is well known in the art. Examples include polyalkylenepolyamine-dicyanodiamide based polycondensation products, water soluble reducing agents, such as sulfites, nitrites, phosphates, thiosulfates, ascorbic acid or salts thereof, hydroxylamine derivatives, and glucose, sulfur-containing compounds, such as thiocyanates, thiourea, 2-mercaptobenzimidazole, 2-mercaptobenzthiazole, 2-mercaptobenzoxazole, 5-mercapto-1-methyl-tetrazole, 2,5-dimercapto-1,3,4-triazole, 2,4,6-trimercaptocyanuric acid, thiosalicylic acid, thiouracil, 1,2-bis(2-hydroxyethylthio) ethane, or hydrophobic antioxidant emulsified dispersions, such as hindered phenol based antioxidants, piperidine based antioxidants or hindered amines. UV absorbers include those described in Japanese Patent Publication Open to Public Inspection Nos. 57-74193, 57-87988, and 2-261476, antifading agents include those described in Japanese Patent Publication Open to Public Inspection Nos. 57-74192, 57-87989, 60-72785, 61-146591, 1-95091, and 3-13376.

The ink receiving layers may include pH modifiers, adhesion promoters, rheology modifiers, latexes, biocides, dyes, optical brighteners, whitening agents, described in Japanese Patent Publication Open to Public Inspection Nos. 59-42993, 59-52689, 62-280069, 61-242871, and 4-219266, and antistatic agents.

The ink receiving layers utilized in the invention can contain one or more mordanting species or polymers. The mordant polymer can be a soluble polymer, a charged molecule, or a crosslinked dispersed microparticle. The mordant can be non-ionic, cationic or anionic. Examples of a mordant are polymers or copolymers containing a quaternized nitrogen moiety, such as, for example, poly(styrene-co-1-vinylimidazole-co-1-vinyl-3-benzylimidazolium chloride), poly(styrene-co-1-vinylimidazole-co-1-vinyl-3-hydroxyethyl-imidazolium chloride), poly(styrene-co-l-vinylimidazole-co-l-vinyl-3-benzylimidazolium chloride-co-1-vinyl-3-hydroxyethylimidazolium chloride), poly (vinylbenzyltrimethylammonium chloride-co-divinylbenzene), poly(ethyl acrylate-co-1-vinylimidazole-co-1-vinyl-3-benzylimidazolium chloride), or poly(styrene-co-4-vinylpyridine-co-4-hydroxyethyl-1-vinylpyridinium chloride). In a preferred embodiment of the invention, the quaternary nitrogen moiety incorporated in the polymer is a salt of trimethylvinylbenzylammonium, benzyldimethylvinylbenzylammonium, dimethyloctadecylvinylbenzylammonium, glycidyltrimethylammonium, 1-vinyl-3-benzylimidazolium, 1-vinyl-3-hydroxyethylimidazolium or 4-hydroxyethyl-1-vinylpyridinium. Preferred counter ions which can be used include chlorides or other counter ions as disclosed in U.S. Pat. Nos. 5,223,338, 5,354,813, and 5,403,955, the disclosures of which are hereby incorporated by reference. Other mordants suitable for the invention are cationic modified products of polymers such as poly(vinyl alcohol), gelatin, chitosan, polyvinylamine, polyethyleneimine, polydimethyldiallyl ammonium chloride, polyalkylene-polyamine dicyandiamide ammonium condensate, polyvinylpyridinium halide, polymers of (meth) acryloyl oxyalkyl quaternary ammonium salt, polymers of (meth) acrylamide alkyl quaternary ammonium salt, ω-chloro-poly (oxyethylene-polymethylene quaternary ammonium alkylate), methyl glycol chitosan, poly(vinylpyridine), propylene oxide based triamines of the Jeffamine T series, made by Texaco, Inc., quaternary acrylic copolymer latexes, phosphonium compounds, sulfonimides, sulfonated polymers and dispersed particles, and alumina hydrate. Other mordants suitable for the invention are polymers, copolymers, or latexes containing carboxylic acid, sulfonic acid, sulfonamide, sulfonimide, or phosphonic acid, such as carboxylated and sulfonated acrylates or methacrylates, carboxylated styrene butadienes, sulfonated nylons, polyesters and polyurethanes, and their salts. In a preferred embodiment of this invention, the mordanting unit may be chemically incorporated within the chemical structure of the polyester bead. For example, a sulfonated monomer within the polyester structure may serve as a mordant for cationic dye species.

In addition to the ink receiving layers, the recording element may also contain other base layers, next to the support, the function of which is to absorb the solvent from the ink. Materials useful for this layer include inorganic particles and polymeric binder, or highly swellable polymers such as gelatin.

The support for the inkjet recording element used in the invention can be any of those usually used for inkjet receivers. The support can be either transparent or opaque. Opaque supports include plain paper, coated paper, resin-coated paper such as polyolefin-coated paper, synthetic paper, photographic paper support, melt-extrusion-coated paper, and polyolefin-laminated paper, such as biaxially oriented support laminates. Biaxially oriented support laminates are described in U.S. Pat. Nos. 5,853,965, 5,866,282, 5,874,205, 5,888,643, 5,888,681, 5,888,683, and 5,888,714, the disclosures of which are hereby incorporated by reference. These biaxially oriented supports include a paper base and a biaxially oriented polyolefin sheet, typically polypropylene, laminated to one or both sides of the paper base. The support can also consist of microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861. Transparent supports include glass, cellulose derivatives, such as a cellulose ester, cellulose triacetate, cellulose diacetate, cellulose acetate propionate, cellulose acetate butyrate, polyesters, such as poly(ethylene terephthalate), poly(ethylene naphthalate), poly-1,4-cyclohexanedimethylene terephthalate, poly(butylene terephthalate), and copolymers thereof, polyimides, polyamides, polycarbonates, polystyrene, polyolefins, such as polyethylene or polypropylene, polysulfones, polyacrylates, polyether imides, and mixtures thereof. The papers listed above include a broad range of papers, from high end papers, such as photographic paper to low end papers, such as newsprint. In a preferred embodiment, Ektacolor paper made by Eastman Kodak Co. is employed. The term as used herein, "transparent" means the ability to pass radiation without significant deviation or absorption.

The support used in the invention may have a thickness of from about 50 to about 500 μm, preferably from about 75 to 300 μm. Antioxidants, brightening agents, antistatic agents, plasticizers and other known additives may be incorporated into the support, if desired.

In order to improve the adhesion of the ink receiving layer to the support, an under-coating or subbing layer may be applied to the surface of the support. This layer may be an adhesive layer such as, for example, halogenated phenols, partially hydrolyzed vinyl chloride-co-vinyl acetate polymer, vinylidene chloride-methyl acrylate-itaconic acid terpolymer, a vinylidene chloride-acrylonitrile-acrylic acid terpolymer, or a glycidyl (meth) acrylate polymer or copolymer. Other chemical adhesives, such as polymers, copolymers, reactive polymers or copolymers, that exhibit good bonding between the ink receiving layer and the support can be used. The polymeric binder in the subbing layer employed in the invention is preferably a water soluble or water dispersible polymer such as poly(vinyl alcohol), poly(vinyl pyrrolidone), gelatin, a cellulose ether, a poly (oxazoline), a poly(vinylacetamide), partially hydrolyzed poly(vinyl acetate/vinyl alcohol), poly(acrylic acid), poly (acrylamide), poly(alkylene oxide), a sulfonated or phosphated polyester or polystyrene, casein, zein, albumin, chitin, chitosan, dextran, pectin, a collagen derivative, collodian, agar-agar, arrowroot, guar, carrageenan, tragacanth, xanthan, rhamsan and the like; a latex such as poly(styrene-co-butadiene), a polyurethane latex, a polyester latex, or a poly(acrylate), poly(methacrylate), poly(acrylamide) or copolymers thereof.

In a preferred embodiment, the subbing layer polymeric binder is a sulfonated polyester dispersion, such as AQ29® (Eastman Chemical Co.), gelatin, a polyurethane or poly (vinyl pyrrolidone). The polymeric binder for the subbing layer is preferably used in an amount of from about 1 to about 50 g/m$^2$, preferably from about 1 to about 20 g/m$^2$.

A borate or borate derivative employed in the subbing layer of the ink jet recording element of the invention may be, for example, borax, sodium tetraborate, boric acid, phenyl boronic acid, or butyl boronic acid. As noted above, the borate or borate derivative is used in an amount of from about 3 to about 50 g/m$^2$, preferably from about 3 to about 10 g/m$^2$. It is believed that upon coating, the borate or borate derivative in the subbing layer diffuses into the image-receiving layer to cross-link the cross-linkable binder in the image-receiving layer.

Other methods to improve the adhesion of the layer to the support include surface treatment of the support by corona-discharge, plasma-treatment in a variety of atmospheres, UV treatment, which is performed prior to applying the layer to the support.

The recording element utilized in the invention can contain one or more conducting layers such as an antistatic layer to prevent undesirable static discharges during manufacture and printing of the image. This may be added to either side of the element. Antistatic layers conventionally used for color films have been found to be satisfactory, such as those in U.S. Pat. No. 5,147,768, the disclosure of which is hereby incorporated by reference. Preferred antistatic agents include metal oxides, e.g., tin oxide, antimony doped tin oxide and vanadium pentoxide. These antistatic agents are preferably dispersed in a film-forming binder.

The layers described above may be coated by conventional coating means onto a support material commonly used in this art. Coating methods may include, but are not limited to, wound wire rod coating, knife coating, slot coating, slide hopper coating, gravure coating, spin coating, dip coating, skim-pan-air-knife coating, multilayer slide bead, doctor blade coating, gravure coating, reverse-roll coating, curtain coating, multilayer curtain coating and the like. Some of these methods allow for simultaneous coatings of more than one layer, which is preferred from a manufacturing economic perspective if more than one layer or type of layer needs to be applied. Known coating and drying methods are described in further detail in Research Disclosure no. 308119, published December 1989, pages 1007 to 1008. Slide coating is preferred, in which several layers may be simultaneously applied. The support may be stationary, or may be moving so that the coated layer is immediately drawn into drying chambers. After coating, the layers are generally dried by simple evaporation, which may be accelerated by known techniques such as convection heating.

The coating composition may be applied to one or both substrate surfaces through conventional pre-metered or post-metered coating methods listed above. The choice of coating process would be determined from the economics of the operation and in turn, would determine the formulation specifications such as coating solids, coating viscosity, and coating speed. After coating, the inkjet recording element may be subject to calendering or supercalendering to enhance surface smoothness. In a preferred embodiment of the invention, the inkjet recording element is subject to hot soft-nip calendering at a temperature of about 65° C. and a pressure of 14000 kg/m at a speed of from about 0.15 m/s to about 0.3 m/s.

Inkjet inks used to image the recording elements of the present invention are well known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946, 4,239,543 and 4,781,758, the disclosures of which are hereby incorporated by reference.

Although the recording elements disclosed herein have been referred to primarily as being useful for inkjet printers, they also can be used as recording media for pen plotter assemblies. Pen plotters operate by writing directly on the surface of a recording medium using a pen consisting of a bundle of capillary tubes in contact with an ink reservoir.

The following examples are intended to further illustrate, but not to limit, the invention.

EXAMPLES

Preparation of Porous Polyester Particles PE-1 through PE-4

Precursor polyesters PP-1 through PP-3 were all synthesized by a 2-stage melt polycondensation process. The chemical compositions are listed in Table 1 and the reaction times and final molecular weights are listed in Table 2. The SIP, CHDM, dibutylstannoic acid, zinc acetate, and sodium acetate were combined in a 500 ml 3-neck flask equipped with a stainless steel stirring rod, nitrogen inlet, and an arm leading to a dry ice/acetone condenser with an outlet connected to a controlled vacuum system. A graduated cylinder was connected beneath the condenser with a ground glass joint to collect and measure distillate. The reaction was heated in a thermostatted bath containing a metal heating alloy. A steady stream of nitrogen was passed over the reaction mixture for 10 minutes, and was then reduced to a slightly positive flow. The temperature was held at 210-230° C. for 100-250 minutes with stirring at ~100 RPM until a clear prepolymer resulted and the calculated amount of methanol distillate had been collected in a graduated cylinder. The reaction was removed from the bath and allowed to cool. The FA and IPA were then added and the condenser was filled with ice. The reaction was restarted at 220° C. and within 20 minutes water condensate began to collect. The reaction was held at 220° C. for 130-460 minutes until the viscosity of the melt had increased to the point where the polyester could no longer be effectively stirred and the reaction was terminated.

TABLE 1

| | FA (g) | SIP (g) | IPA (g) | Mol ratio FA:SIP:IPA | CHDM (g) | $Zn(OAc)_2$ (g) | $BuSn(OH)_3$ (g) | NaOAc (g) |
|---|---|---|---|---|---|---|---|---|
| PP-1 | 19.59 | 50.01 | — | 1:1:0 | 45.57 | 0.02 | 0.02 | 0.69 |
| PP-2 | 21.43 | 27.35 | 15.34 | 2:1:1 | 51.13 | 0.02 | 0.02 | 0.38 |
| PP-3 | 48.99 | 125.02 | — | 1:1:0 | 116.42 | 0.06 | 0.04 | 1.73 |

FA is fumaric acid
SIP is dimethyl 5-sulfoisophthalate, sodium salt
IPA is isophthalic acid
CHDM is 1,4-cyclohexanedimethanol, mixture of cis and trans isomers.

TABLE 2

| | Stage 1 reaction time | Stage 2 reaction time | Mn | Mw |
|---|---|---|---|---|
| PP-1 | 120 min | 130 min | 2,710 | 10,500 |
| PP-2 | 100 min | 420 min | 3,570 | 15,800 |
| PP-3 | 250 min | 200 min | 3,240 | 7,330 |

Precursor polyester PP-4 was synthesized using the same apparatus as used above for PP-1 through PP-3, and a similar 2-stage procedure. In the first stage, SIP (82.41 g, 0.28 mol), hydroquinone-bis-hydroxyethyl ether (HQBHE) (110.29 g, 0.56 mol), sodium acetate (2.28 g), and titanium isopropoxide (4 drops) were combined in a 500 ml 3-neck round bottom flask and heated for 220-240° C. for 70 minutes at which point a clear, slightly orange prepolymer had formed and the calculated amount of methanol condensate had been collected. The reaction was then cooled and diethyl fumarate (47.90 g, 0.28 mol) was added. The reaction was restarted and was heated at 200° C. for 100 minutes followed by 120 minutes at 220° C. A vacuum was then initiated which ramped from ambient pressure to 20 torr over 2 minutes. The viscosity of the melt began to rapidly increase and the reaction was terminated. (Mn=2940, Mw=5440).

Polyester particles PE-1 through PE-4 were all synthesized by the following procedure. An aqueous phase was prepared by dispersing appropriate precursor polyester in the amount of water noted in Table 3. The water generally had to be heated to 40-60° C. and it required between 20 minutes and 16 hours for the precursor polyester to completely disperse, depending on the amount of SIP monomer in the precursor polyester. The aqueous phase was filtered through cheesecloth and combined in a beaker with an organic phase consisting of the toluene, DVB, hexadecane, and AIBN. The 2 phases were emulsified by any of the three methods listed in Table 3 and transferred to an appropriately sized 3-neck 1 L round bottom flask fitted with a mechanical stirrer and a reflux condenser with nitrogen inlet. The opaque white microsuspensions were bubble degassed with nitrogen for 10 minutes, then heated overnight at 70° C. for 16 hours. The resulting particle dispersions were cooled to room temperature and the toluene was removed as a water azeotrope via rotary evaporation. The dispersions were washed with 4-6 volumes of water and concentrated to 9-25% solids using a Millipore Amicon ultrafiltration system with a 100 K cutoff spiral-wound dialysis cartridge. The exact concentrations of each PE dispersion are listed in Table 4.

TABLE 3

| Dispersion | Precursor polyester | Precursor polyester (g) | Water (ml) | DVB[1] (g) | Toluene (g) | AIBN[4] (g) | Hexadecane (ml) | Emulsification method |
|---|---|---|---|---|---|---|---|---|
| PE-1 | PP-1 | 20.00 | 240 | 20.00 | 40.00 | 0.40 | 4.14 | M[2] |
| PE-2 | PP-2 | 20.00 | 240 | 20.00 | 40.00 | 0.40 | 4.14 | M[2] |
| PE-3 | PP-3 | 62.50 | 750 | 68.38 | 125.00 | 1.25 | 12.94 | H[3] |
| PE-4 | PP-4 | 40.00 | 514 | 40.0 | 80.0 | 0.80 | 2.82 | H[3] |
| PE-5 | PP-4 | 25.25 | 122 | 20.25 | 0 | 0.41 | 0.81 | H[3] |

[1]DVB is divinylbenzene (80% w/w with remainder being ethylstyrene, mixture of m and p isomers.)
[2]Reaction mixture was passed twice through an M-110T Microfluidizer (sold by Microfluidics).
[3]Reaction mixture was homogenized for 10 minutes using a Silverson L4 mixer on the highest setting.
[4]AIBN is 2,2'-azobis(isobutyronitrile)

Determination of Particle Size and Particle Size Distribution

The particle size and particle size distribution of each particle was measured using a laser scattering particle size distribution analyzer, Horiba LA-920, manufactured by Horiba LTD. The results for PE-1 through PE-4 are in Table 4.

TABLE 4

| | | Mode 1 | | | Mode 2 | | |
|---|---|---|---|---|---|---|---|
| PE dispersion | Wt % solids | Mean diameter (micron) | Proportion (%) | CV (%) | Mean diameter (micron) | Proportion (%) | CV (%) |
| PE-1 | 13.54 | 0.356 | 100 | 35.2 | — | — | — |
| PE-2 | 12.97 | 0.181 | 5.9 | 15.9 | 0.351 | 94.1 | 36.8 |
| PE-3 | 22.86 | 1.082 | 9.1 | 44.2 | 2.69 | 90.9 | 27.1 |
| PE-4 | 17.60 | 0.434 | 27.6 | 45.3 | 4.46 | 72.4 | 57.5 |

Example 1

Preparation of Control Element C-1 (Single Layer of Larger Size Particles)

A coating composition was prepared from 53.92 wt. % of dispersion PE-3, 2.18 wt. % poly(vinyl alcohol), PVA, (Gohsenol® GH-17 from Nippon Gohsei Co., Ltd.), and 43.90 wt. % water. The relative proportions of porous polyester particle to PVA are therefore 85/15 by weight. The coating composition was metered to a slot-die coating apparatus and coated onto a base support comprised of a polyethylene resin coated photographic paper stock, which had previously been subjected to corona discharge treatment, moving at a speed of about 2.4 m/min. The coated support immediately entered the drying section of the coating machine to remove substantially all solvent components and form an ink receiving layer. The thickness of the dry ink receiving layer was measured to be about 15±2 μm. The measured surface gloss, print density of the cyan patch at Dmax, and the ink dry time are reported in Table 5.

Preparation of Element 1

A coating composition (Solution S-3) was prepared the same as in Control Element C-1. A second coating composition (Solution S-1) was prepared from 62.78 wt. % of dispersion PE-1, 1.5 wt. % poly(vinyl alcohol), PVA, (Gohsenol® GH-17 from Nippon Gohsei Co., Ltd.), and 35.72 wt. % water. [The relative proportions of porous polyester particle to PVA are therefore 85/15 by weight]. Both coating compositions were metered to a multiple-slot-die coating apparatus and coated simultaneously, with Solution S-3 being located below (closer to the support than) Solution S-1, onto a base support comprised of a polyethylene resin coated photographic paper stock, which had previously been subjected to corona discharge treatment, moving at a speed of about 2.4 m/min. The coated support immediately entered the drying section of the coating machine to remove substantially all solvent components and form a two-layer image receiving element. The combined thickness of the dry ink receiving layers was measured to be about 19±2 μm. The measured surface gloss, print density of the cyan patch at Dmax, and the ink dry time are reported in Table 5.

Preparation of Element 2

Coating compositions S-3 and S-1 were prepared the same as Element 1 except that Solution S-1 was 59.08 wt. % of dispersion PE-1, 2.0 wt. % poly(vinyl alcohol), PVA, (Gohsenol® GH-17 from Nippon Gohsei Co., Ltd.), and 38.92 wt. % water. The relative proportions of porous polyester particle to PVA are therefore 80/20 by weight. The coating composition were coated and dried the same as Element 1, with Solution S-3 being located below (closer to the support than) Solution S-1. The combined thickness of the dry ink receiving layers was measured to be about 20±2 μm. The measured surface gloss, print density of the cyan patch at Dmax, and the ink dry time are reported in Table 5.

Preparation of Element 3

A coating composition (Solution S-3) was prepared the same as in Control Element C-1. A second coating composition (Solution S-2) was prepared from 65.54 wt. % of dispersion PE-2, 1.5 wt. % poly(vinyl alcohol), PVA, (Gohsenol® GH-17 from Nippon Gohsei Co., Ltd.), and 32.96 wt. % water. The relative proportions of porous polyester particle to PVA are therefore 85/15 by weight. The coating compositions were coated and dried the same as Element 1, with Solution S-3 being located below (closer to the support than) Solution S-2. The thickness of the dry lower layer was measured to be about 12±2 μm and the thickness of the dry upper layer was measured to be about 9±2 μm. The measured surface gloss, print density of the cyan patch at Dmax, and the ink dry time are reported in Table 5.

Preparation of Element 4

Coating compositions S-3 and S-2 were prepared, coated and dried the same as Element 3 except that the thickness of the layers were different. The combined thickness of the dry ink receiving layers was measured to be about 12±2 μm. The measured surface gloss, print density of the cyan patch at Dmax, and the ink dry time are reported in Table 5.

Preparation of Element 5

A coating composition (Solution S-3) was prepared the same as in Control Element C-1. A second coating composition S-4 was prepared from 48.30 wt. % of dispersion PE-4, 1.5 wt. % poly(vinyl alcohol), PVA, (Gohsenol® GH-17 from Nippon Gohsei Co., Ltd.), and 50.20 wt. % water. The relative proportions of porous polyester particle to PVA are therefore 85/15 by weight. The coating composition were coated and dried the same as Element 1, with Solution S-3 being located below (closer to the support than) Solution S-4. The thickness of the dry lower layer was measured to be about 20±2 μm and the thickness of the dry upper layer was measured to be about 5±2 μm. The measured surface gloss, print density of the cyan patch at Dmax, and the ink dry time are reported in Table 5.

Printing

The above elements and control elements of Example 1 were printed using a Lexmark Z51 inkjet printer and a cyan inkjet ink, prepared using a standard formulation with a copper phthalocyanine dye (Clariant Direct Turquoise Blue FRL-SF). The red channel density (cyan) patches at D-max (the highest density setting) were read using an X-Rite ® 820 densitometer. The cyan density is reported in Table 5.

Surface Gloss Measurement

The gloss of the top surface of the unprinted ink receiving layer was measured using a BYK Gardner gloss meter at an angle of illumination/reflection of 60°. The results are related to a highly polished black glass with a refractive index of 1.567 that has a specular gloss value of 100. The results are reported in Table 5.

Measurement of Ink Dry Time

A drop (from a 10 microliter capillary tube) of a magenta inkjet ink, prepared using a standard formulation with Dye 6 from U.S. Pat. No. 6,001,161, was placed on each unprinted element and the time that it took for this spot to become dry to the touch was measured as the "ink drying time" as shown in Table 5.

TABLE 5

| Element | Cyan D-max | 60° gloss | Ink drying time (seconds) |
|---|---|---|---|
| 1 | 1.7 | 23 | 100 |
| 2 | 1.6 | 30 | 120 |
| 3 | 1.7 | 65 | 120 |
| 4 | 1.7 | 48 | 180 |
| 5 | 1.6 | 10 | 20 |
| Control C-1 | 1.1 | 3 | >180 |

The above results show that higher surface gloss and improved print density for the element can be achieved with a multilayer ink receiving layer structure when the upper layer contains porous polyester particles that have a mean diameter of less than 0.5 micrometers.

Example 2

Synthesis of Core-Shell Latex Dispersion D-1

The core-shell latex employed in this invention was prepared by a sequential emulsion polymerization technique in which the core polymer latex is polymerized first, followed by the sequential feeding of a second monomer suspension. The following reagents were used in this synthesis.

A: Deionized water (50 g) Triton 770® (30% active) (0.4 g)

B: Potassium persulfate (0.12 g)

C: Methyl methacrylate (17.1 g) Sodium 2-sulfo-1,1-dimethylethyl acrylamide (0.9 g) Potassium persulfate (0.1 g) Triton 770® (30% active) (0.9 g) Deionized water (35 g)

D: Ethyl acrylate (3.6 g) Vinylidene chloride (31.0 g) Sodium 2-sulfo-1,1-dimethylethyl acrylamide (1.44 g) Potassium persulfate (0.21 g) Sodium bisulfate (0.42 g) Triton 770® (30% active) (5.80 g) Deionized water (160 g)

Reagent combination A was charged to a 1L 3-neck flask equipped with a nitrogen inlet, mechanical stirrer and condenser. The flask was immersed in a constant temperature bath at 80° C. and purged with nitrogen for 20 min. Reagent B was added and followed by the addition of reagent mixture C over 2 hours. The mixture (C) was agitated with constant agitation to keep the mixture in the form of a suspension. The polymerization was continued for 30 min and the latex was cooled to 40° C. The second monomer suspension (D) was prepared and added in the same way. The total addition time was two hours. The latex was heated at 40° C. for one additional hour and 4 ml of 10 wt. % t-butyl hydroperoxide and 10 wt. % formaldehyde-sulfite were added to remove the residual monomer. The reaction was held for 30 min, cooled to room temperature and filtered, resulting in dispersion D-1.

The latex dispersion had a pH=2.0 and was adjusted to a pH=6.0 by adding a few drops of a dilute solution of sodium hydroxide. The concentration of the aqueous dispersion was 16.74 wt. % solids. The mean diameter of the particles was measured to be 117 nanometers.

Preparation of Element 6

A coating composition (Solution S-3) was prepared the same as in Control Element C-1. A second coating composition (Solution S-5) was prepared from 50.8 wt. % of dispersion D-1, 1.5 wt. % poly(vinyl alcohol), PVA, (Gohsenol® GH-17 from Nippon Gohsei Co., Ltd.), and 47.7 wt. % water. The relative proportions of organic polymer particle to PVA are therefore 85/15 by weight. Both coating compositions were metered to a multiple-slot-die coating apparatus and coated simultaneously, with Solution S-3 being located below (closer to the support than) Solution S-5, onto a base support comprised of a polyethylene resin coated photographic paper stock, which had been previously subjected to corona discharge treatment, moving at a speed of about 2.4 m/min. The coated support immediately entered the drying section of the coating machine to remove substantially all solvent components and form a two-layer image receiving element. The combined thickness of the dry ink receiving layers was measured to be about 26±2 μm. The element was printed the same as in Example 1. The surface gloss and print density of the cyan patch at Dmax were measured the same as in Example 1 and the results are reported in Table 6.

Synthesis of Non-Porous Polyester Particle

Non-porous polymer particle PE-5 were synthesized by the same procedure used for PE-1 through PE-4 except that the toluene component was not added, and thus the azeotropic removal step was not needed. The concentration of the aqueous dispersion was 12.78 wt. % solids. The mean diameter of the particles was measured to be 307 nanometers.

Preparation of Element 7

A coating composition (Solution S-3) was prepared the same as in Control Element C-1. A second coating composition (Solution S-6) was prepared from 66.5 wt. % of polyester particle PE-5, 1.5 wt. % poly(vinyl alcohol), PVA, (Gohsenol® GH-17 from Nippon Gohsei Co., Ltd.), and 32.0 wt. % water. The relative proportions of polyester particle to PVA are therefore 85/15 by weight. Both coating compositions were metered to a multiple-slot-die coating apparatus and coated simultaneously, with Solution S-3 being located below (closer to the support than) Solution S-6, onto a base support comprised of a polyethylene resin coated photographic paper stock, which had been previously subjected to corona discharge treatment, moving at a speed of about 2.4 m/min. The coated support immediately entered the drying section of the coating machine to remove substantially all solvent components and form a two-layer image receiving element. The combined thickness of the dry ink receiving layers was measured to be about 28±2 μm. The element was printed the same as in Example 1. The surface gloss and print density of the cyan patch at Dmax were measured the same as in Example 1 and the results are reported in Table 6.

Preparation of Element 8

A coating composition (Solution S-3) was prepared, coated, and dried the same as in Control Element C-1, forming layer L-1. A second coating composition (Solution S-7) was prepared from 55.2 wt. % of colloidal silica solution TX-11005 (30.8 wt % silica in water, listed particle size is 118 nanometers, from Nalco Chemical Company), 3.0 wt. % poly(vinyl alcohol), PVA, (Gohsenol® GH-17 from Nippon Gohsei Co., Ltd.), and 41.8 wt. % water. The relative proportions of silica particle to PVA are therefore 85/15 by weight. Solution S-7 was coated over the layer L-1 using a calibrated coating knife, and dried to remove substantially all solvent components to form layer L-2. The thickness of layer L-1 was measured to be about 15±2 μm, and the thickness of layer L-2 was measured to be about 3±2 μm. The element was printed the same as in Example 1. The surface gloss and print density of the cyan patch at Dmax were measured the same as in Example 1 and the results are reported in Table 6.

Preparation of Element 9

A coating composition (Solution S-3) was prepared, coated, and dried the same as in Control Element C-1, forming layer L-1. A second coating composition (Solution S-8) was prepared from 42.5 wt. % of a fumed alumina solution (40 wt. % alumina in water, Cab-O-Sperse® PG003 from Cabot Corporation), 1.8 wt. % poly(vinyl alcohol), PVA, (Gohsenol® GH-17 from Nippon Gohsei Co., Ltd.), 0.8 wt % of 2,3-dihydroxy-1,4-dioxane (Clariant Corp.), and 54.9 wt. % water. Solution S-8 was coated over the layer L-1 using a calibrated coating knife, and dried to remove substantially all solvent components to form layer L-3. The thickness of layer L-1 was measured to be about 15±2 μm, and the thickness of layer L-3 was measured to be about 3±2 μm. The element was printed the same as in Example 1. The surface gloss and print density of the cyan patch at Dmax were measured the same as in Example 1 and the results are reported in Table 6.

Preparation of Element 10

A coating composition (Solution S-3) was prepared, coated, and dried the same as in Control Element C-1, forming layer L-1. A second coating composition (Solution S-9) was prepared from 100 wt. % of Viviprint 540 (10 wt % polyvinylpyrrolidone hydrogel in water from International Specialty Products). Solution S-9 was coated over the layer L-1 using a calibrated coating knife, and dried to remove substantially all solvent components to form layer L-4. The thickness of layer L-1 was measured to be about 15±2 μm, and the thickness of layer L-4 was measured to be about 4±2 μm. The element was printed the same as in Example 1. The surface gloss and print density of the cyan patch at Dmax were measured the same as in Example 1 and the results are reported in Table 6.

Preparation of Element 11

A coating composition (Solution S-3) was prepared, coated, and dried the same as in Control Element C-1, forming layer L-1. A second coating composition (Solution S-10) was prepared from 10 wt. % poly(vinyl alcohol), PVA, (Airvol 203S from Air Products and Chemicals, Inc.) and 90 wt. % water. Solution S-10 was coated over the layer L-1 using a calibrated coating knife, and dried to remove substantially all solvent components to form layer L-5. The thickness of layer L-1 was measured to be about 15±2 μm, and the thickness of layer L-5 was measured to be about 1±0.5 μm. The element was printed the same as in Example 1. The surface gloss and print density of the cyan patch at Dmax were measured the same as in Example 1 and the results are reported in Table 6.

TABLE 6

| Element | Particle in lower ink receiving layer | Particle in upper ink receiving layer | Cyan D-max | 60° gloss |
|---|---|---|---|---|
| 6 | PE-3 | D-1 | 1.7 | 21 |
| 7 | PE-3 | PE-5 | 1.6 | 44 |
| 8 | PE-3 | TS-11005 silica | 1.6 | 10 |
| 9 | PE-3 | Fumed alumina | 2.0 | 25 |
| 10 | PE-3 | none | 2.0 | 41 |
| 11 | PE-3 | none | 1.9 | 15 |

The above results show that higher surface gloss and improved print density for the element can be achieved, relative to those obtained with control element C-1, with a multilayer ink receiving layer structure, particularly when the upper layer contains organic or inorganic particles that have a mean diameter of less than 0.5 micrometers or a surface layer substantially free of particles.

Example 3

Preparation of Control Element C-2

Control Element C-2 was a commercially available inkjet non-porous receiver paper containing an ink receiving layer comprised of a high amount of gelatin, "Kodak Inkjet Photo Paper", catalogue No. 1181197 from Eastman Kodak Co. The element was printed the same as in Example 1. The surface gloss, and the ink dry time were measured the same as in Example 1. The measured surface gloss at 60 degrees was 84 and the ink dry time was measured to be 150 seconds.

Preparation of Element 12

A coating composition (Solution S-2) was prepared the same as in Element 3. Solution S-2 was coated over the Control Element C-2 using a calibrated coating knife, and dried to remove substantially all solvent components. The thickness of this layer was measured to be about 3±1 μm. The element was printed the same as in Example 1. The surface gloss, and the ink dry time were measured the same as in Example 1. The measured surface gloss at 60 degrees was 57 and the ink dry time was measured to be 20 seconds, much faster than that measured for Control Element C-2.

Example 4

Preparation of Control Element C-3

Control Element C-3 was a commercially available inkjet porous receiver paper containing ink receiving layer comprising a high amount of silica fine particles, "Epson Premium Glossy Photo Paper", catalogue No. SO41286 from Epson.

Preparation of Element 13

A coating composition (Solution S-2) was prepared the same as in Element 3 and was coated over the Control Element C-3 using a calibrated coating knife, and dried to remove substantially all solvent components. The thickness of this layer was measured to be about 4±2 μm.

Preparation of Control Element C-4

A coating composition (Solution S-11) was prepared by combining fumed alumina (Cab-O-Sperse® PG003, Cabot Corp.), poly(vinyl alcohol) (Gohsenol® GH-23A, Nippon Gohsei Co., Ltd.) and 2,3-dihydroxy-1,4-dioxane (Clariant Corp.) in a weight ratio of 88:10:2 to give an aqueous coating formulation of 30% solids by weight.

A coating solution (Solution S-12) was prepared by combining fumed alumina (Cab-O-Sperse® PG003, Cabot Corp.), poly(vinyl alcohol) (Gohsenol® GH-23A, Nippon Gohsei Co.) and a copolymer of (vinylbenzyl) trimethylammonium chloride and divinylbenzene (87:13 molar ratio) in a weight ratio of 85:3:12 to give an aqueous coating formulation of 10% solids by weight. The fumed alumina particles have a primary particle size of from about 7 to about 40 nm in diameter and are aggregated up to about 150 nm. Surfactants Zonyl® FSN (E. I. du Pont de Nemours and Co.) and Olin® 10G (Dixie Chemical Co.) were added in small amounts as coating aids.

Both coating compositions were metered to a multiple-slot-die coating apparatus and coated simultaneously at 40° C., with Solution S-11 being located below (closer to the support than) Solution S-12, onto a base support comprised of a polyethylene-coated paper base which had been previously subjected to corona discharge treatment. The coated support immediately entered the drying section of the coating machine to remove substantially all solvent components and form a two-layer image receiving element. The thicknesses of the bottom and topmost layers were 40 μm and 2 μm, respectively.

Preparation of Element 14

A coating composition (Solution S-2) was prepared the same as in Element 3 and was coated over the Control Element C-4 using a calibrated coating knife, and dried to remove substantially all solvent components. The thickness of this layer was measured to be about 4±2 μm.

Preparation of Control Element C-5

A coating composition for a base layer was prepared by mixing 254 dry g of precipitated calcium carbonate Albagloss-s® (Specialty Minerals Inc.) as a 70 wt. % solution, 22 dry g of silica gel Gasil® 23F (Crosfield Ltd.), 2.6 dry g of poly(vinyl alcohol) Airvol® 125 (Air Products) as a 10 wt. % solution and 21 dry g of styrene-butadiene latex CP692NA® (Dow Chemicals) as a 50 wt. % solution. The wt. % solids of the coating composition was adjusted to 35 wt. % by adding water. The base layer coating composition was bead-coated at 25° C. on a paper support with basis weight of 185 g/m$^2$ (Eastman Kodak Co.) and dried by forced air at 45° C. The thickness of the base layer was 25 μm.

Preparation of Element 15

A coating composition (Solution S-2) was prepared the same as in Element 3 and was coated over the Control Element C-5 using a calibrated coating knife, and dried to remove substantially all solvent components. The thickness of this layer was measured to be about 2±0.5 μm.

Measurement of Ink Dry Time

A drop (from a 5 microliter capillary tube) of a magenta inkjet ink, prepared using a standard formulation with Dye 6 from U.S. Pat. No. 6,001,161, was placed on each unprinted element and the time that it took for this spot to become dry to the touch was measured as the "ink drying time".

Printing and Dye Stability Testing

The above elements and control elements of Example 4 were printed using a Lexmark Z51 inkjet printer and a cyan inkjet ink, prepared using a standard formulation with a copper phthalocyanine dye (Clariant Direct Turquoise Blue FRL-SF). The red channel density (cyan) patches at D-max (the highest density setting) were read using an X-Rite® 820 densitometer. The cyan density is reported in Table 5. The printed elements were then subjected to 4 days exposure to a nitrogen flow containing 5 ppm ozone. The density of each patch was read after the exposure test using an X-Rite® 820 densitometer. The % dye retention was calculated as the ratio of the density after the exposure test to the density before the exposure test. The results for cyan D-max are reported in Table 7.

TABLE 7

| Element | Particle in lower ink receiving layer | Particle in upper ink receiving layer | Cyan D-max | % dye retention cyan D-max | 60° gloss | Ink drying time (seconds) |
|---|---|---|---|---|---|---|
| 13 | Silica | PE-2 | 1.6 | 96.3 | 71 | 20 |
| 14 | Fumed alumina | PE-2 | 1.6 | 95.0 | 49 | 20 |
| 15 | Calcium carbonate, latex | PE-2 | 2.0 | 95.5 | 20 | 30 |
| C-3 | Silica | None | 2.1 | 19.7 | 41 | 30 |
| C-4 | Fumed alumina | None | 1.9 | 19.6 | 62 | 45 |
| C-5 | Calcium carbonate, latex | None | 0.7 | 80.3 | 6 | 20 |

The above results show that improved dye stability for the element can be achieved, while maintaining surface gloss and ink dry time, with a multilayer ink receiving layer structure, particularly when the upper layer contains porous polyester particles that have a mean diameter of less than 0.5 micrometers.

The invention has been described in detail with particular reference to certain preferred embodiments thereof, but it will be understood that variations and modifications can be effected within the spirit and scope of the invention.

What is claimed is:

1. An unprinted inkjet recording element comprising a support having thereon at least two ink receiving layers, wherein the topmost layer of said inkjet recording element, having a thickness of from about 1 to about 10 micrometer, comprises a hydrophilic polymeric binder and porous crosslinked polyester-containing particles, wherein said porous crosslinked polyester-containing particles have a mean diameter of less than 0.5 micrometers;

wherein the crosslinked porous polyester-containing particles are prepared by crosslinking unsaturated precursor polyester within an oil-in-water emulsion in the presence of a water-immiscible organic solvent, wherein the water-immiscible organic solvent is removed to yield a dispersion of porous crosslinked polyester-containing particles.

2. The inkjet recording element of claim 1 wherein said porous crosslinked polyester-containing particles are present in at least one layer below the topmost layer of said inkjet recording element.

3. The inkjet recording element of claim 2 wherein said porous crosslinked polyester-containing particles in the at least one layer below the topmost layer comprise particles having a mean diameter of greater than 0.5 micrometers.

4. The inkjet recording element of claim 2 wherein said porous crosslinked polyester-containing particles in the at least one layer below the topmost layer comprise particles having a mean particle diameter of between 1 and 3 micrometers.

5. The inkjet recording element of claim 2 wherein said porous crosslinked polyester-containing particles in the at least one layer below the topmost layer comprise particles having a mean particle diameter of between 1 and 10 micrometers.

6. The inkjet recording element of claim 1 wherein said inkjet recording element further comprises at least one layer below said topmost layer, said layer comprising organic or inorganic particles.

7. The inkjet recording element of claim 6 wherein said inorganic particles comprise silica, alumina, calcium carbonate, clay, or barium sulfate.

8. The inkjet recording element of claim 6 wherein said organic particles comprise styrene-butadiene latex, polyurethane latex, or an acrylic latex.

9. The inkjet recording element of claim 1 wherein said inkjet recording element comprises at least one layer below said topmost layer comprising a swellable polymer.

10. The inkjet recording element of claims 9 wherein said swellable polymer comprises at least one member selected from the group consisting of gelatin, poly(vinyl alcohol), and a sulfonated polyester.

11. The inkjet recording element of claim 1 wherein said inkjet recording element has a surface gloss of greater than or equal to 10 at a measurement angle of 60 degrees.

12. The inkjet recording element of claim 1 wherein said hydrophilic polymeric binder is selected from at least one member of the group consisting of poly(vinyl alcohol), gelatin, sulfonated polyester, and water dispersible polyurethane.

13. The inkjet recording element of claim 1 wherein said crosslinked porous polyester-containing particles comprise precursor polyester comprising at least one member the group consisting of maleic, fumaric, itaconic, phenylenediacrylic, citraconic and mesaconic acid.

14. The inkjet recording element of claim 13 wherein said precursor polyester further comprises sulfonated monomer.

15. The inkjet recording element of claim 13 wherein said precursor polyester has an acid number of at least 10.

16. The inkjet recording element of claim 13 wherein said precursor polyester has a number average molecular weight of 1,000 to 30,000.

17. The inkjet recording element of claim 13 wherein said crosslinked porous polyester-containing particles further comprise the copolymerization product of at least one ethylenically unsaturated monomer selected from the group consisting of styrene, divinylbenzene, divinyl adipate, or cyclohexanedimethanol divinyl ether.

18. The inkjet recording element of claim 1 wherein said crosslinked porous polyester-containing particles have an ionic group equivalent weight of between 40 and 2000 grams per mole of ionic unit.

19. The inkjet recording element of claim 18 wherein said ionic group comprises sulfonate functionality.

20. The inkjet recording element of claim 1 wherein said crosslinked porous polyester-containing particles comprise between 50 and 95% by weight of said at least one layer of said at least two ink receiving layers.

21. The inkjet recording element of claim 20 wherein said particles comprise between 75 and 90% by weight of said at least one layer of said at least two ink receiving layers.

22. The inkjet recording element of claim 1 having a thickness of between 10 and 50 micrometers.

23. An unprinted inkjet recording element comprising a support having thereon at least two ink receiving layers, wherein the topmost layer of said inkjet recording element, having a thickness of from about 1 to about 10 micrometer, comprises a hydrophilic polymeric binder and porous crosslinked polyester-containing particles, wherein said porous crosslinked polyester-containing particles have a mean diameter of less than 0.5 micrometers and wherein said crosslinked porous polyester-containing particles have an ionic group equivalent weight of between 40 and 2000 grams per mole of ionic unit;

wherein porous polyester particles having a mean diameter of greater than 0.5 micrometers are present in at least one layer below the topmost layer of said inkjet recording element;

wherein said crosslinked porous polyester-containing particles in both the topmost layer and in the at least one layer below the topmost layer comprise between 50 and 95% by weight of the respective layer; and wherein the crosslinked porous polyester-containing particles in both the topmost layer and in the at least one layer below the topmost layer are prepared by crosslinking unsaturated precursor polyester within an oil-in-water emulsion in the presence of a water-immiscible organic solvent, wherein the water-immiscible organic solvent is removed to yield a dispersion of porous crosslinked polyester-containing particles.

* * * * *